US007779509B2

(12) United States Patent
Jian

(10) Patent No.: US 7,779,509 B2
(45) Date of Patent: Aug. 24, 2010

(54) SLIDING HINGE

(75) Inventor: Jia-Yan Jian, Shulin (TW)

(73) Assignee: Shin Zu Shing Co., Ltd., Taipei Hsien (TW)

( * ) Notice: Subject to any disclaimer, the term of this patent is extended or adjusted under 35 U.S.C. 154(b) by 464 days.

(21) Appl. No.: 11/986,441

(22) Filed: Nov. 21, 2007

(65) Prior Publication Data

US 2009/0126158 A1 May 21, 2009

(51) Int. Cl.
*E05D 11/06* (2006.01)

(52) U.S. Cl. ..... 16/359; 16/361; 16/239

(58) Field of Classification Search ..... 16/358, 16/359, 360, 361, 239, 242, 357, 352, 353, 16/362, 364; 455/575.4, 575.3; 379/433.01, 379/433.12, 433.13; 361/679.05, 679.27, 361/679.13, 679.56
See application file for complete search history.

(56) References Cited

U.S. PATENT DOCUMENTS 7,021,728 B2 * 4/2006 Donovan et al. ..... 312/7.2
7,546,150 B2 * 6/2009 Makino ..... 455/575.1
7,567,830 B2 * 7/2009 Hur ..... 455/575.4
7,685,680 B2 * 3/2010 Chien et al. ..... 16/361
2006/0046797 A1 * 3/2006 Chen ..... 455/575.4
2006/0211460 A1 * 9/2006 Jeong et al. ..... 455/575.4
2006/0223596 A1 * 10/2006 Hur ..... 455/575.4
2008/0004083 A1 * 1/2008 Ohki et al. ..... 455/566
2008/0051162 A1 * 2/2008 Kim et al. ..... 455/575.3
2008/0064452 A1 * 3/2008 Kim et al. ..... 455/575.3
2008/0096619 A1 * 4/2008 Kuga et al. ..... 455/575.4
2008/0242380 A1 * 10/2008 Kajihara et al. ..... 455/575.4
2008/0301909 A1 * 12/2008 Chien et al. ..... 16/362
2009/0049646 A1 * 2/2009 Rubin et al. ..... 16/319

* cited by examiner

*Primary Examiner*—Chuck Y. Mah
(74) *Attorney, Agent, or Firm*—William E. Pelton, Esq.; Cooper & Dunham LLP

(57) ABSTRACT

A sliding hinge is mounted between a cover and a base of an electronic device and has a stationary leaf, a moving leaf, a resilient device, a main linkage and a secondary linkage. The stationary leaf is connected to the base. The moving leaf is connected to the cover and is mounted slidably on the stationary leaf. The resilient device is mounted pivotally on the stationary leaf. The main linkage is mounted pivotally on the stationary leaf and is connected pivotally to the moving leaf and the resilient device. The secondary linkage is mounted pivotally on the stationary leaf and is connected pivotally to the moving leaf. The cover is moved to slide relative to the base by the moving leaf and the main and secondary linkages. Furthermore, the resilient device keeps the cover closed or fully opened without external forces.

13 Claims, 8 Drawing Sheets

SLIDING HINGE

BACKGROUND OF THE INVENTION

1. Field of the Invention

The present invention relates to a sliding hinge, especially to a sliding hinge mounted between a cover and a base to allow the cover to slide relative to the base.

2. Description of the Prior Arts

With the developing of modern technology, handheld electronic devices such as cell phones, PDAs, video games, and the like have been getting more and more popular. However, as functions of the handheld electronic devices mature, to gain a market edge a manufacturer has to develop modified appearances of the electronic devices. For example, cell phones used to be a single elongated handset having a single display on a single face. Now cell phones have multiple different designs including foldable designs with single display or dual-displays, sliding designs with single display or with dual-displays and rotating designs. All of foldable, sliding and rotating designs require a corresponding hinge to allow a cover of the cell phone to pivot or slide or rotate relative to a base of the cell phone. Sliding designs tend to open unsmoothly, have short travel and only open linearly.

SUMMARY OF THE INVENTION

The main objective of the present invention is to provide a sliding hinge. The sliding hinge is mounted between a cover and a base of an electronic device and has a stationary leaf, a moving leaf, a resilient device, a main linkage and a secondary linkage. The stationary leaf is connected to the base. The moving leaf is connected to the cover and is mounted slidably on the stationary leaf. The resilient device is mounted pivotally on the stationary leaf. The main linkage is mounted pivotally on the stationary leaf and is connected pivotally to the moving leaf and the resilient device. The secondary linkage is mounted pivotally on the stationary leaf and is connected pivotally to the moving leaf. The cover is moved to slide relative to the base by the moving leaf and the main and secondary linkages. Furthermore, the resilient device keeps the cover closed or fully opened without external forces.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
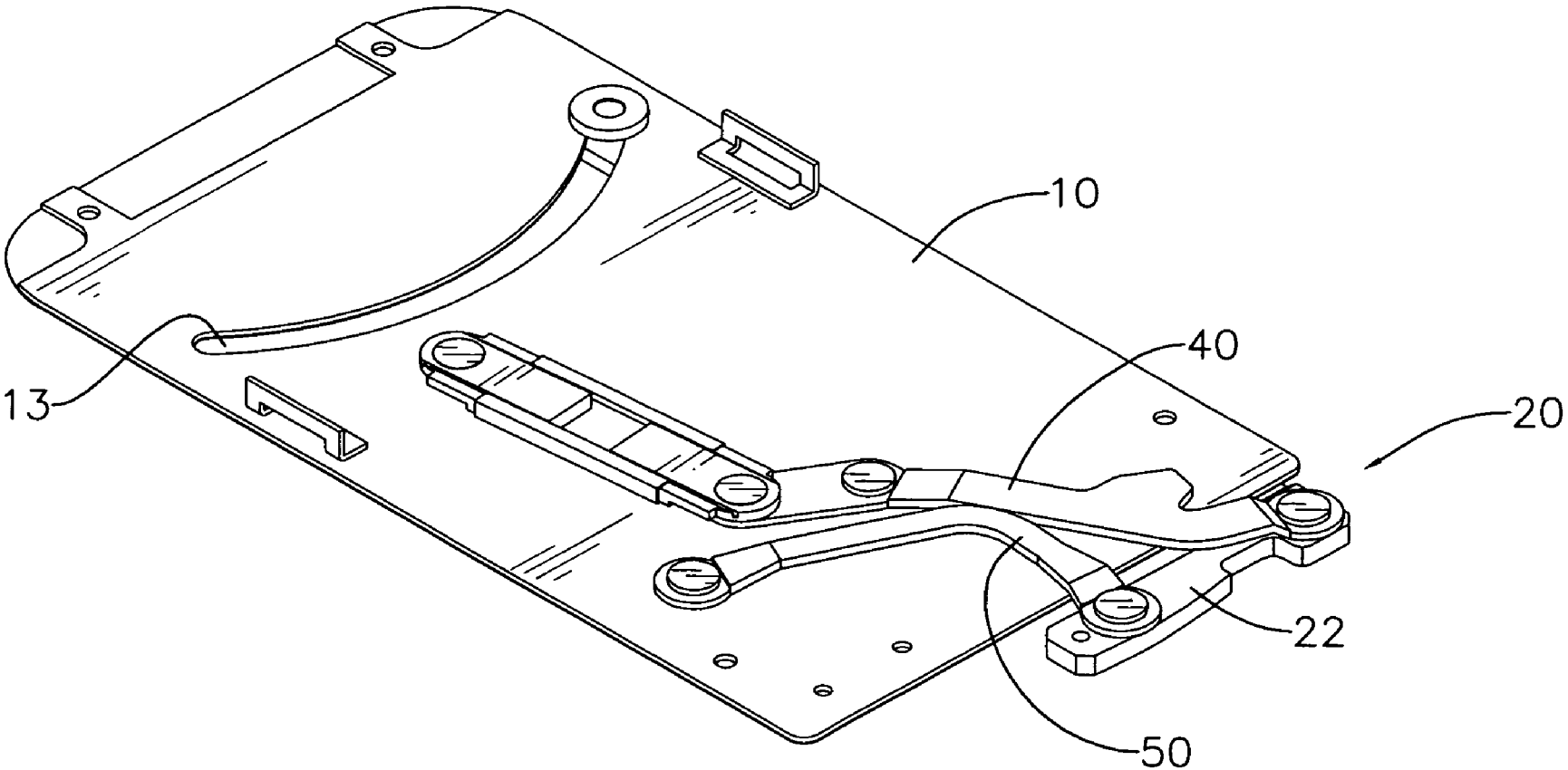
FIG. 1 is a perspective view of a sliding hinge in accordance with the present invention.
Figure 2:
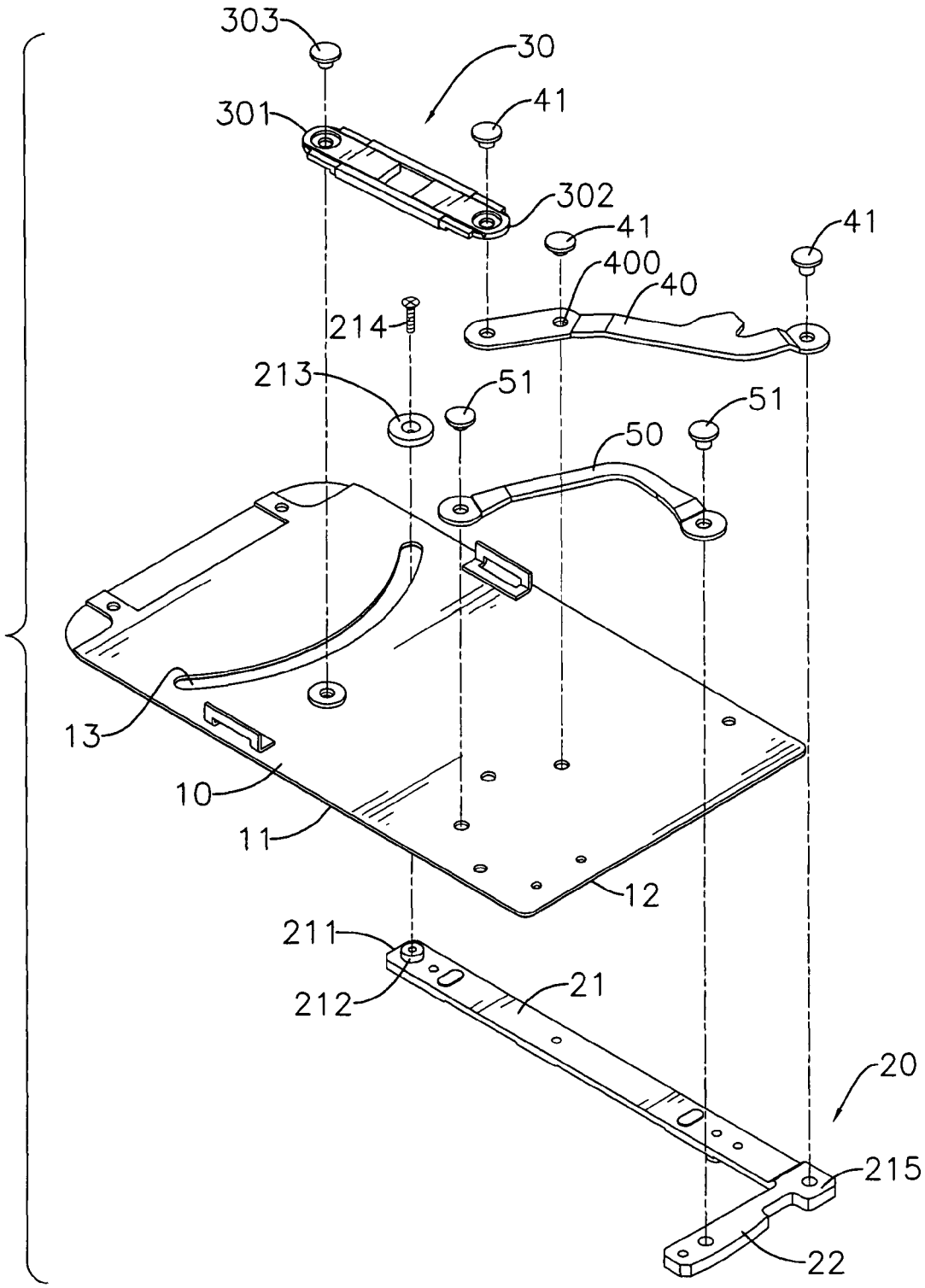
FIG. 2 is an exploded perspective view of the sliding hinge in FIG. 1.
Figure 8:
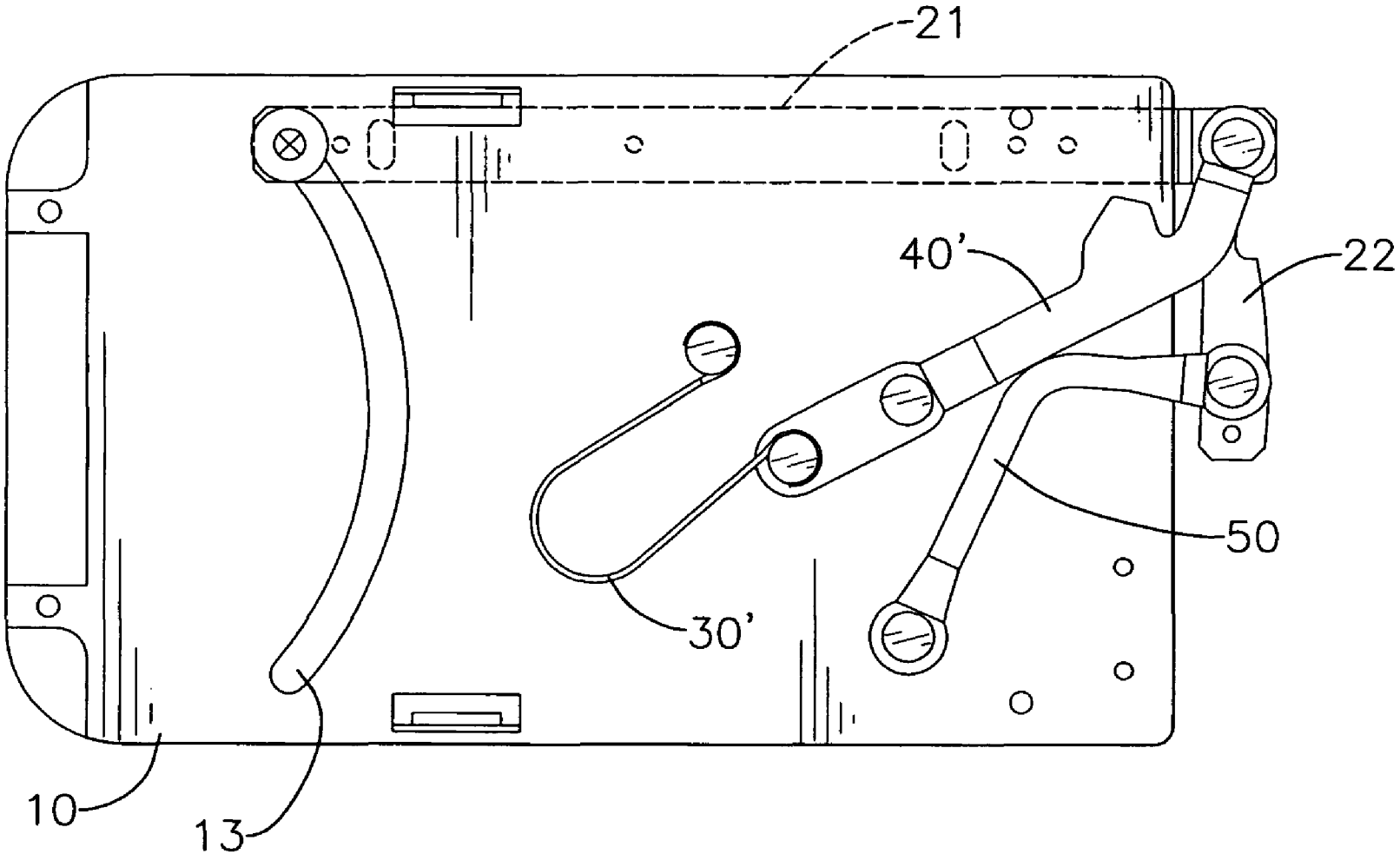
FIG. 8 is an operational front view of another embodiment of a sliding hinge in accordance with the present invention, shown closed.

With reference to FIGS. 1, 2 and 8, a sliding hinge in accordance with the present invention comprises a stationary leaf (10), a moving leaf (20), a resilient device (30, 30'), a main linkage (40) and a secondary linkage (50).

The stationary leaf (10) has a front surface, a rear surface and a guide slot (13), may be rectangular and may have two longitudinal sides (11) and two short sides (12). The guide slot (13) is an arc, is formed through the stationary leaf (10) and may be disposed from one longitudinal side (11) to another longitudinal side (11). The short sides (12) are shorter than the longitudinal sides (11).

The moving leaf (20) is mounted movably on the rear surface of the stationary leaf (10) and comprises a main rod (21) and a branch (22). The main rod (21) is connected slidably to the slot (13) in the stationary leaf (10) from the rear surface of the stationary leaf (10), has a proximal end (211), a distal end (215) and may have a guide (212), a washer (213) and a fastener (214). The proximal end (211) is mounted slidably in the slot (13). The guide (212) is formed on the proximal end (211) and protrudes through the slot (13) from the rear surface to the front surface of the stationary leaf (10). The washer (213) is mounted around the guide (212) and abuts the front surface of the stationary leaf (10). The fastener (214) mounted through the washer (213) and the guide (212) and on the proximal end (211) to connect the proximal end (211) slidably to the slot (13).

The branch (22) is formed on the distal end (215) of the main rod (21) and may be formed perpendicularly on the distal end (215) of the main rod (21).

Figure 3:
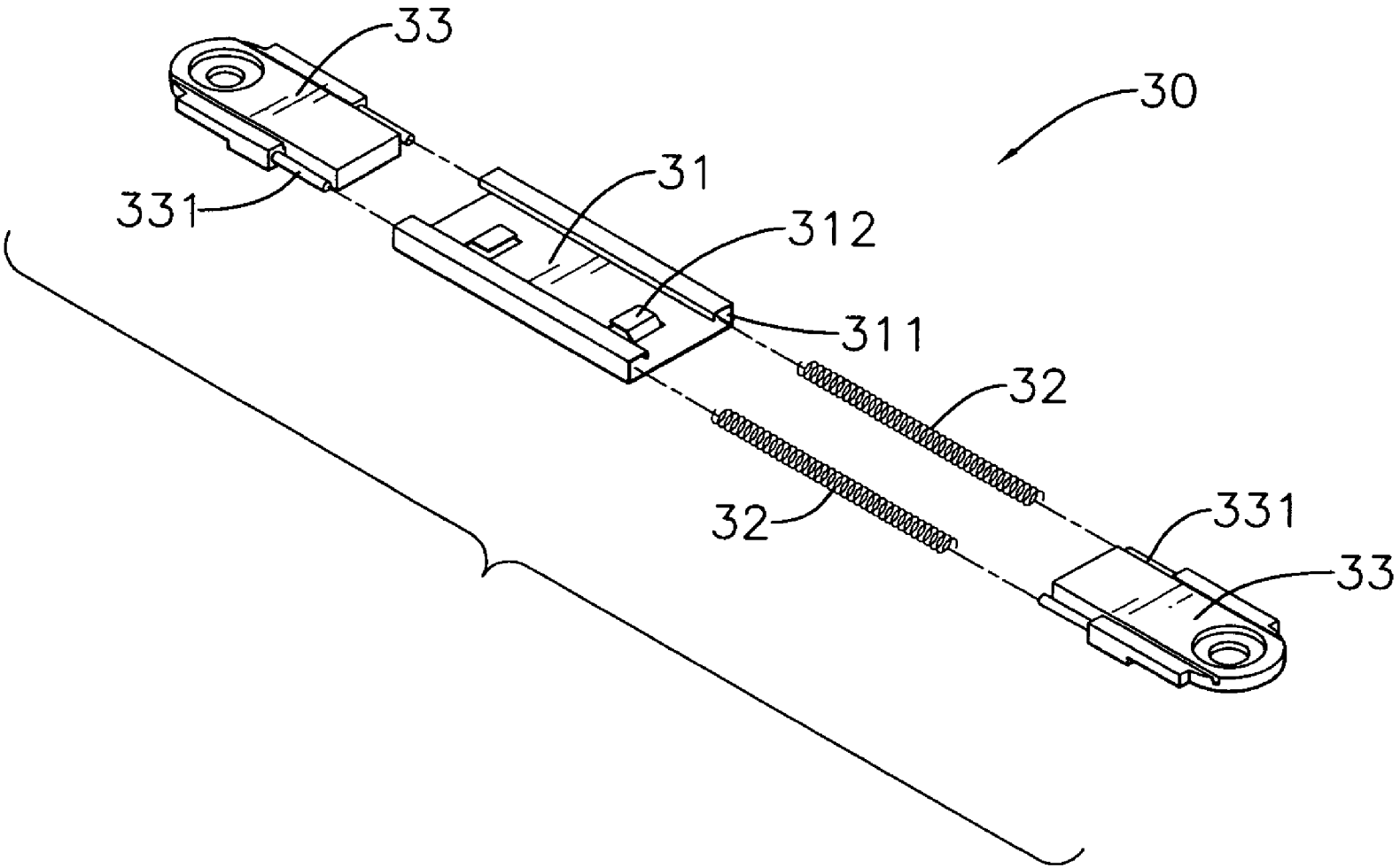
FIG. 3 is an exploded perspective view of a resilient device of the sliding hinge in FIG. 1.
Figure 4:
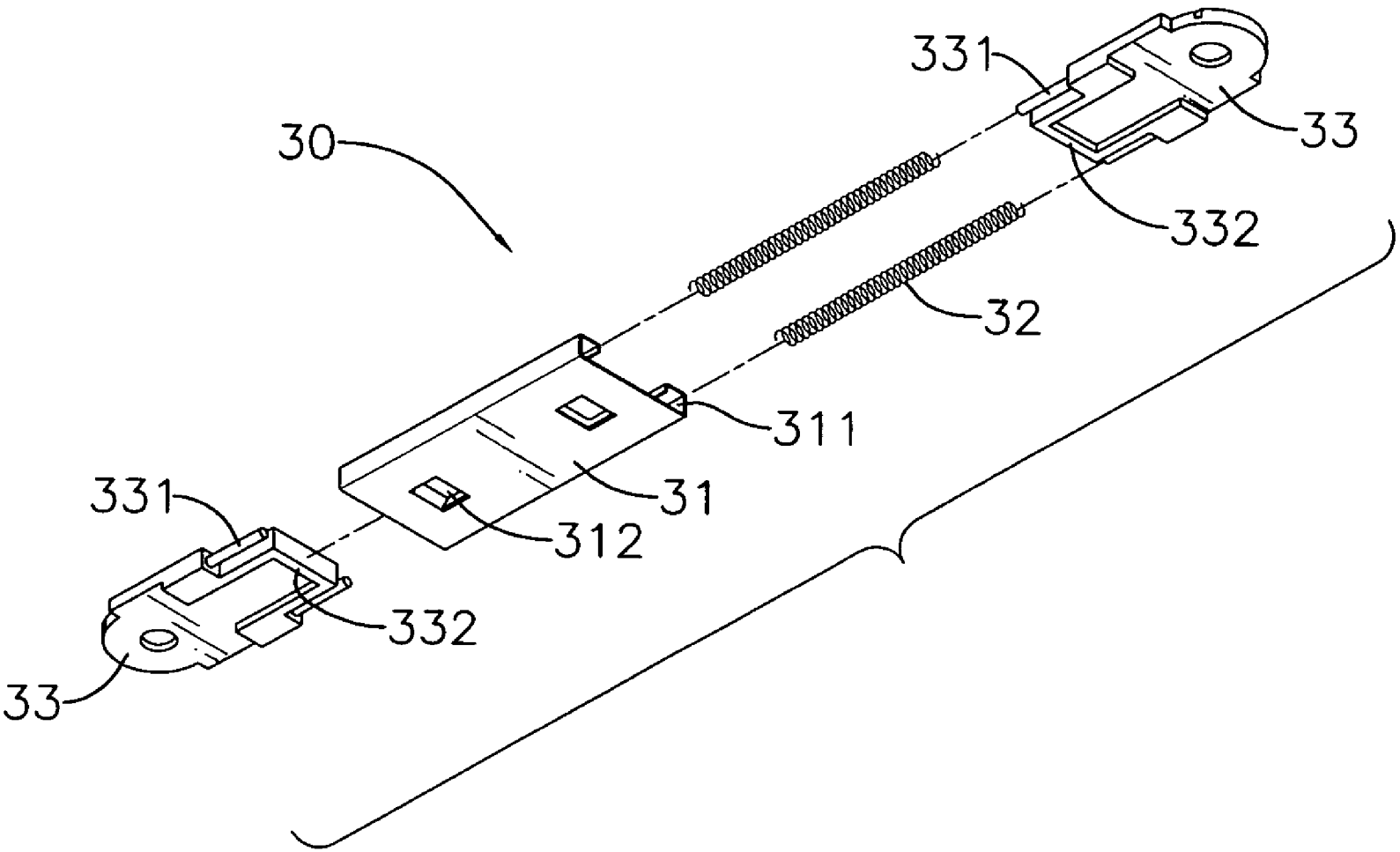
FIG. 4 is an exploded, rear perspective view of the resilient device in FIG. 3.

With further reference to FIGS. 3 and 4, the resilient device (30, 30') is mounted pivotally on the front surface of the stationary leaf (10), has a pivoting end (301) and a connecting end (302) and may be a slide assembly or a torsion spring. The pivoting end (301) is mounted pivotally on the front surface of the stationary leaf (10) that may be using a pivot pin (303). The pivot pin (303) is mounted through the pivoting end (301) and is mounted securely in the stationary leaf (10) to mount the pivoting end (301) pivotally on the stationary leaf (10).

The slide assembly comprises a bracket (31), two compression springs (32) and two slides (33).

The bracket (31) has a front surface, two ends, two opposite sidewalls, two mounting recesses (311) and two hooks (312). The mounting recesses (311) are formed respectively in the sidewalls of the bracket (31). The hooks (312) are formed separately on the front surface of the bracket (31), respectively near the ends of the bracket (31).

The compression springs (32) are mounted respectively in the mounting recesses (311) of the bracket (31).

The slides (33) are mounted slidably on the front surface of the bracket (31), are mounted respectively from the ends of the bracket (31) and are pushed by the springs (32). One slide (33) is connected pivotally to the front surface of the stationary leaf (10).

Each slide (33) has two sides, a bottom surface, two rod mounts, two spring rods (331) and a limit (332). The bottom surface of the slide (33) slides adjacent to a corresponding hook (312). The rod mounts are formed respectively on the sides of the slide (33) and each rod mount has a free end. The free ends of the rod mounts of the slide (33) abut and are pushed by the springs (32). The spring rods (331) are formed on and protrude respectively from the free ends of the rod mounts of the slide (33) and are slidably mounted respectively in the mounting recesses (311) of the bracket (31). The limit (332) is formed on and protrudes out from the bottom surface and selectively abuts the corresponding hook (312) on the bracket (31) to keep the slide (33) on the bracket (31).

The main linkage (40, 40') is mounted pivotally on the front surface of the stationary leaf (10) and has a first end, a second end, a central segment (400) and an optional pivot pin (41). The first end of the main linkage (40, 40') is connected to the connecting end (302) of the resilient device (30, 30') and may be connected to a corresponding slide (33) of the resilient device (30). The second end of the main linkage (40, 40') is connected to the moving leaf (20). The central segment (400) of the main linkage (40, 40') may be curved and is mounted rotatably on the front surface of the stationary leaf (10). The pivot pin (41) is mounted through the central segment (400) and the stationary leaf (10) to mount the central segment (400) rotatably on the stationary leaf (10).

The secondary linkage (50) is mounted pivotally on the front surface of the stationary leaf (10) and the branch (22) of the moving leaf (20) and has a first end, a second end and two optional pivot pins (51). The first end of the secondary linkage (50) is mounted rotatably on the front surface of the stationary leaf (10). The second end of the secondary linkage (50) is mounted rotatably on the branch (22) of the movably assembly (20). The pivot pins (51) are respectively mounted through the ends of the secondary linkage (50), and are connected respectively to the stationary leaf (10) and the branch (22) to mount the secondary linkage (50) pivotally on the stationary leaf (10) and the moving leaf (20).

The pivot pins (303, 41, 51) may be rivets.

The sliding hinge as described is mounted in a sliding electronic device with a cover and a base. The stationary leaf (10) connects to the base, and the moving leaf (20) connects to the cover.

Figure 5:
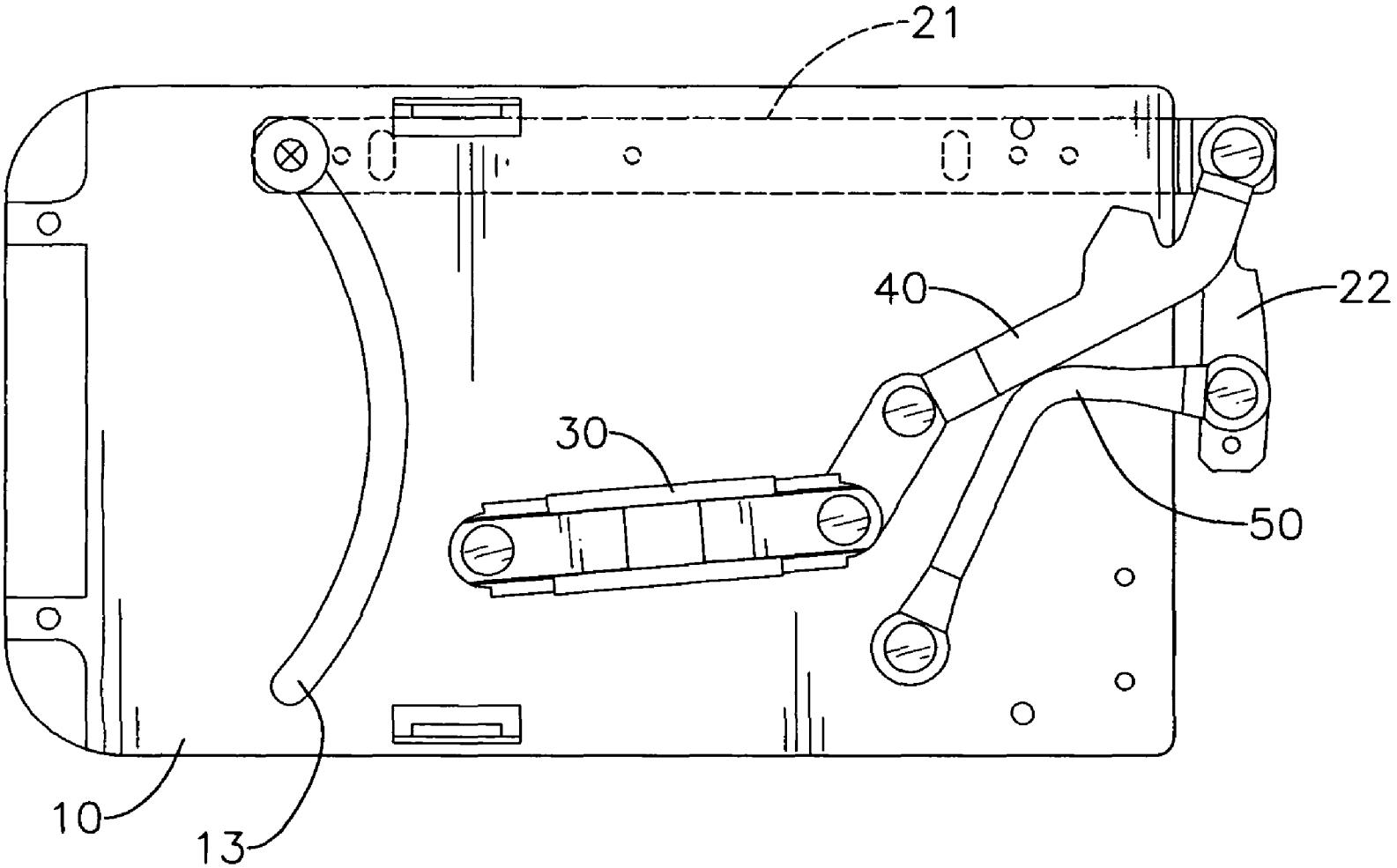
FIG. 5 is an operational front view of the sliding hinge in FIG. 1 when closed.

With further reference to FIG. 5, the cover is closed relative to the base. The resilient device (30) pushes the moving leaf (20) to maintain the cover in a closed position.

Figure 6:
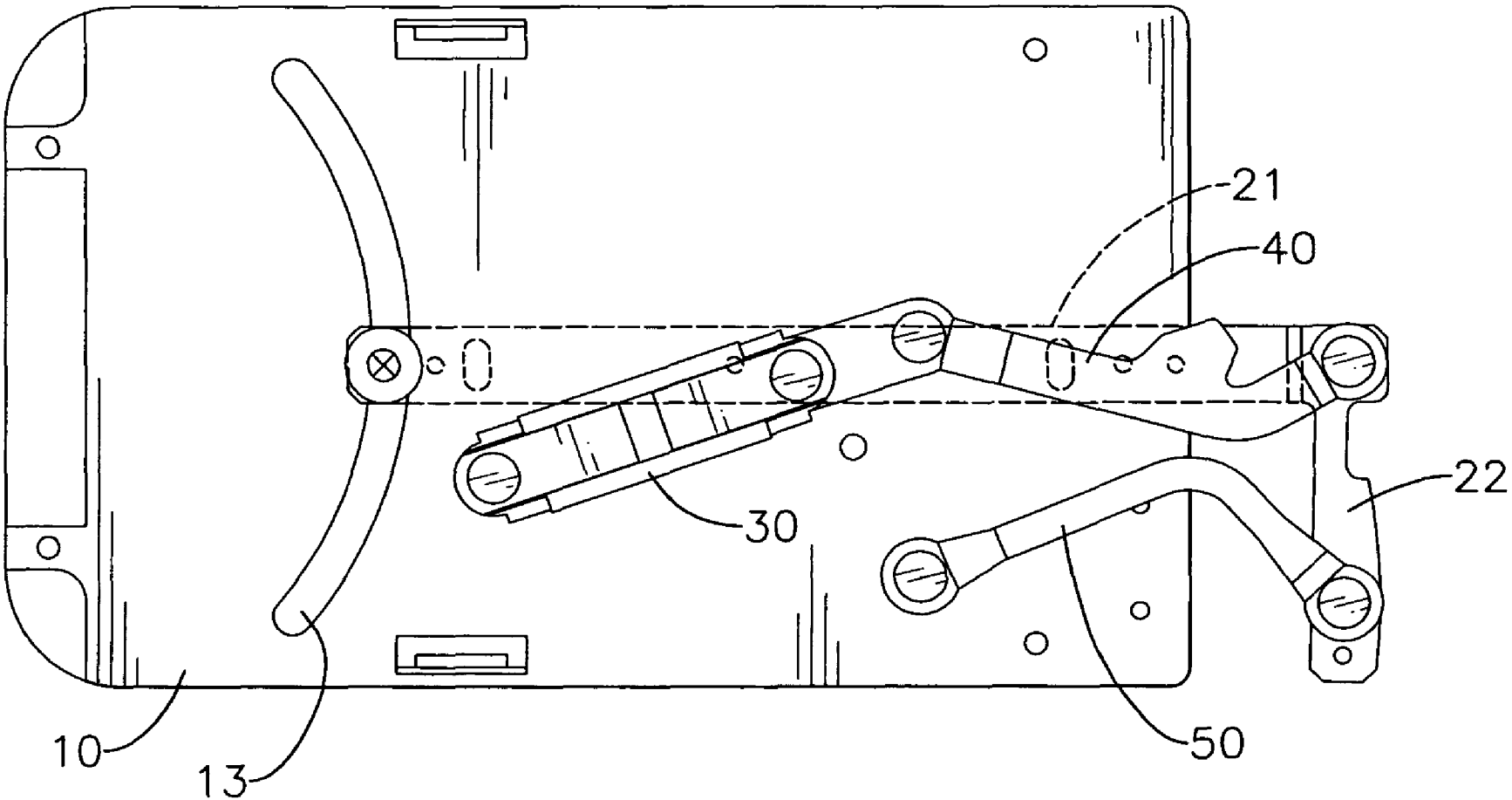
FIG. 6 is an operational front view of the sliding hinge in FIG. 1 when being opened.

With further reference to FIG. 6, the cover is opened relative to the base. The cover is pulled away to resist the resilient force of the resilient device (30). Therefore, the moving leaf (20) is moved away from the stationary leaf and allows the main linkage (40) and the secondary linkage (50) to pivot.

Figure 7:
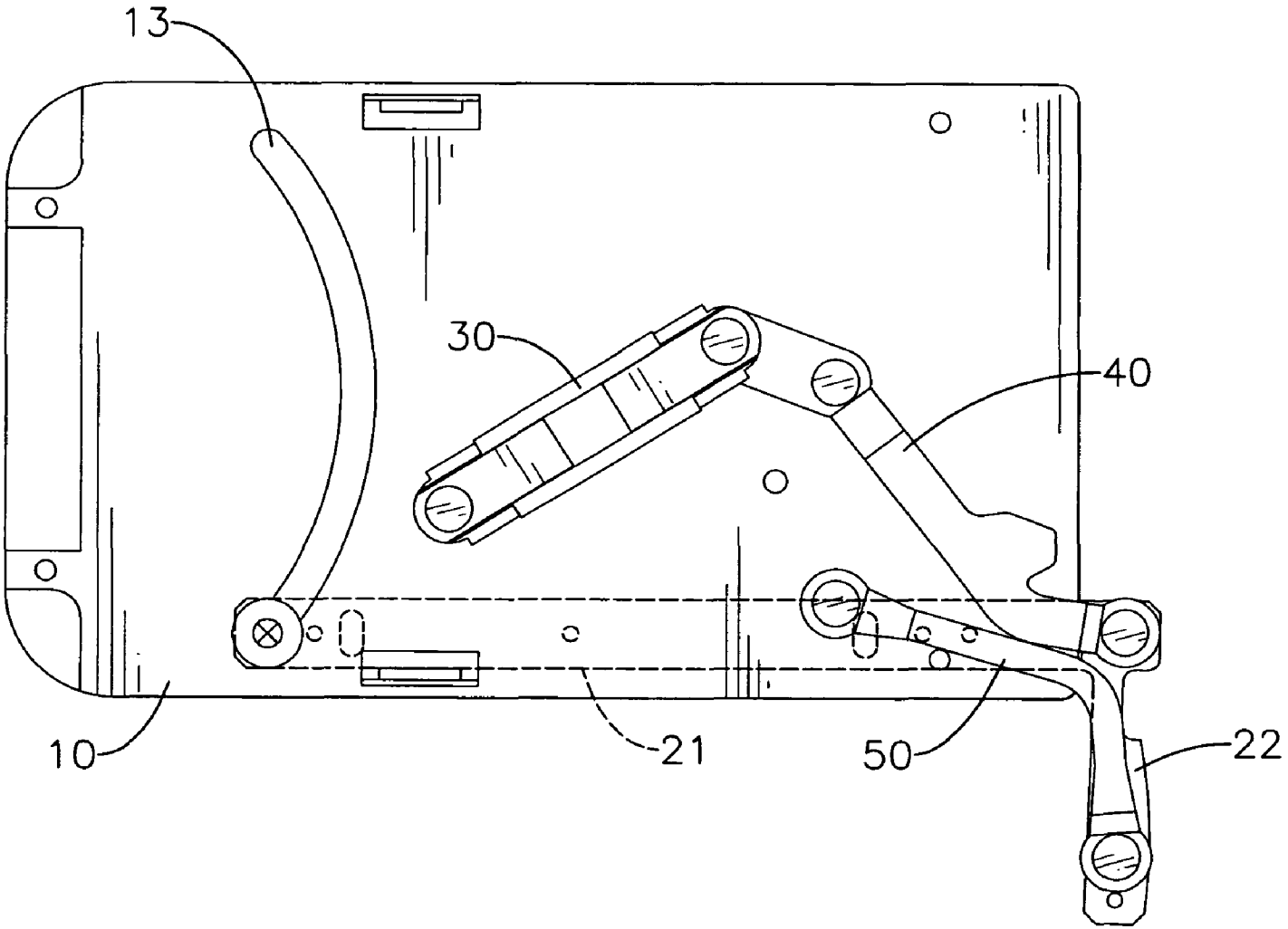
FIG. 7 is an operational front view of the sliding hinge in FIG. 1 when fully opened.

With further reference to FIG. 7, the cover is fully opened relative to the base. The resilient device (30) pushes the moving leaf (20) to maintain the cover in a fully opened position.

Therefore, with the moving leaf (20) and the main and secondary linkages (40, 50), the sliding hinge as described allows the cover to slide relative to the base. Further, the resilient device (30) keeps the cover at the closed or fully opened positions without external force. Therefore, the present invention provides a smooth sliding hinge for sliding electronic devices.

Even though numerous characteristics and advantages of the present invention have been set forth in the foregoing description, together with details of the structure and features of the invention, the disclosure is illustrative only. Changes may be made in the details, especially in matters of shape, size, and v arrangement of parts within the principles of the invention to the full extent indicated by the broad general meaning of the terms in which the appended claims are expressed.

What is claimed is:

1. A sliding hinge comprising:

a stationary leaf having
- a front surface;
- a rear surface; and
- a guide slot being an arc formed through the stationary leaf;

a moving leaf being mounted movably on the rear surface of the stationary leaf and comprising
- a main rod being connected slidably to the slot in the stationary leaf from the rear surface of the stationary leaf and having
  - a proximal end being mounted slidably in the slot; and
  - a distal end; and
- a branch being formed on the distal end of the main rod;

a resilient device being mounted pivotally on the front surface of the stationary leaf and having
- a pivoting end being mounted pivotally on the front surface of the stationary leaf; and
- a connecting end;

a main linkage being mounted pivotally on the front surface of the stationary leaf and having
- a first end being connected to the connecting end of the resilient device;
- a second end being connected to the moving leaf; and
- a central segment being mounted rotatably on the front surface of the stationary leaf; and a secondary linkage having
- a first end being mounted rotatably on the front surface of the stationary leaf; and
- a second end being mounted rotatably on the branch of the moving leaf.

2. The sliding hinge as claimed in claim 1, wherein the resilient device is a torsion spring.

3. The sliding hinge as claimed in claim 2, the main rod of the moving leaf has a guide being formed on the proximal end and protruding through the slot from the rear surface to the front surface of the stationary leaf;

a washer being mounted around the guide of the main rod and abutting the front surface of the stationary leaf; and a fastener being mounted through the washer and the guide.

4. The sliding hinge as claimed in claim 3, wherein the resilient device has a pivot pin being mounted through the pivoting end of the resilient device and being mounted securely in the stationary leaf;

the main linkage has a pivot pin being mounted through the central segment of the main linkage and the stationary leaf; and the secondary linkage has two pivot pins being respectively mounted through the ends of the secondary linkage, and being connected respectively to the stationary leaf and the branch.

5. The sliding hinge as claimed in claim 4, wherein the stationary leaf is rectangular and has two longitudinal sides and two short sides, the short sides being shorter than the longitudinal sides; and the guide slot of the stationary leaf is disposed from one longitudinal side to an other longitudinal side of the stationary leaf.

6. The sliding hinge as claimed in claim 1, wherein the resilient device is a slide assembly and comprises a bracket having
- a front surface;
- two ends;
- two opposite sidewalls; and
- two mounting recesses being formed respectively in the sidewalls of the bracket;

two compression springs being mounted respectively in the mounting recesses of the bracket; and two slides being mounted slidably on the front surface of the bracket, being mounted respectively from the ends of the bracket and being pushed by the springs, wherein one of the slides is connected pivotally to the front surface of the stationary leaf;

the first end of the main linkage is connected to the a corresponding slide of the resilient device; and the central segment of the main linkage is curved.

7. The sliding hinge as claimed in claim 6, wherein the bracket of the resilient device has two hooks being formed separately on the front surface of the bracket, respectively near the ends of the bracket; and each slide of the resilient device has two sides;

a bottom surface; and a limit being formed on and protruding out from the bottom surface of the slide and selectively abutting a corresponding hook on the bracket.

8. The sliding hinge as claimed in claim 7, wherein each slide of the resilient device has two rod mounts being formed respectively on the sides of the slide and each rod mount having a free end abutting and being pushed by the springs; and two spring rods being formed on and protruding respectively from the free ends of the rod mounts of the slide and being slidably mounted respectively in the mounting recesses of the bracket.

9. The sliding hinge as claimed in claim 8, the main rod of the moving leaf has a guide being formed on the proximal end and protruding through the slot from the rear surface to the front surface of the stationary leaf;

a washer being mounted around the guide of the main rod and abutting the front surface of the stationary leaf; and a fastener being mounted through the washer and the guide.

10. The sliding hinge as claimed in claim 9, wherein the stationary leaf is rectangular and has two longitudinal sides and two short sides, the short sides being shorter than the longitudinal sides; and the slot of the stationary leaf is disposed from on longitudinal side to an other longitudinal side of the stationary leaf.

11. The sliding hinge as claimed in claim 1, the main rod of the moving leaf has a guide being formed on the proximal end and protruding through the slot from the rear surface to the front surface of the stationary leaf;

a washer being mounted around the guide of the main rod and abutting the front surface of the stationary leaf; and a fastener being mounted through the washer and the guide.

12. The sliding hinge as claimed in claim 11, wherein the resilient device has a pivot pin being mounted through the pivoting end of the resilient device and being mounted securely in the stationary leaf;

the main linkage has a pivot pin being mounted through the central segment of the main linkage and the stationary leaf; and the secondary linkage has two pivot pins being respectively mounted through the ends of the secondary linkage, and being connected respectively to the stationary leaf and the branch.

13. The sliding hinge as claimed in claim 12, wherein the stationary leaf is rectangular and has two longitudinal sides and two short sides, the short sides being shorter than the longitudinal sides; and the guide slot of the stationary leaf disposed from one longitudinal side to another longitudinal side of the stationary leaf.

* * * * *